US008707621B2

(12) United States Patent
Curtis et al.

(10) Patent No.: US 8,707,621 B2
(45) **Date of Patent: *Apr. 29, 2014**

(54) OUTSWINGING WINDOW ASSEMBLY HAVING AN OPERATIONAL MODE AND A WASH MODE AND METHOD OF OPERATION

(75) Inventors: Daniel J. Curtis, Warroad, MN (US); Gregory J. Vetter, Owatonna, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/253,321

(22) Filed: Oct. 5, 2011

(65) Prior Publication Data

US 2012/0023826 A1 Feb. 2, 2012

Related U.S. Application Data

(63) Continuation of application No. 12/062,471, filed on Apr. 3, 2008, now Pat. No. 8,046,954.

(60) Provisional application No. 60/909,913, filed on Apr. 3, 2007, provisional application No. 60/909,924, filed on Apr. 3, 2007.

(51) Int. Cl.
*E05D 15/40* (2006.01)

(52) U.S. Cl.
USPC ..... 49/249; 49/246; 49/248; 49/250; 49/260; 49/261

(58) Field of Classification Search
USPC ..... 49/246, 247, 248, 249, 250, 260, 261, 49/172, 174
See application file for complete search history.

(56) References Cited

U.S. PATENT DOCUMENTS

| | | | |
|---|---|---|---|
| 1,614,435 | A | 1/1927 | Renton |
| 1,760,994 | A | 6/1930 | Piotti |
| 2,648,878 | A | 8/1953 | Albano |
| 2,797,917 | A | 7/1957 | Lickteig, Jr. et al. |
| 3,345,777 | A | 10/1967 | Anderberg et al. |
| 3,497,909 | A | 3/1970 | Davis |
| 4,106,237 | A | 8/1978 | Bierlich |
| 4,253,276 | A | 3/1981 | Peterson et al. |

(Continued)

FOREIGN PATENT DOCUMENTS

| | | |
|---|---|---|
| DE | 10148793 | 8/2002 |
| DE | 10148793 A1 | 8/2002 |

(Continued)

OTHER PUBLICATIONS

"U.S. Appl. No. 12/062,471, Examiner Interview Summary mailed Apr. 25, 2011", 3 pgs.

(Continued)

*Primary Examiner* — Jerry Redman
(74) *Attorney, Agent, or Firm* — Schwegman, Lundberg & Woessner, P.A.

(57) ABSTRACT

A window assembly including a frame having an interior portion with an inner surface, and a sash having an interior portion and an exterior portion. The window assembly includes an operational mode and a wash mode. In the operational mode, the sash is movable from a closed position to a position in which the sash is generally perpendicular with the frame. In the wash mode, the sash is movable to a position where the exterior of the sash faces toward the interior frame.

32 Claims, 16 Drawing Sheets

(56) References Cited

U.S. PATENT DOCUMENTS

| | | | |
|---|---|---|---|
| 4,301,622 | A | 11/1981 | Dunsmoor |
| 4,392,330 | A | 7/1983 | Buhr |
| 4,555,829 | A | 12/1985 | Davis |
| 4,622,715 | A | 11/1986 | Buckley |
| 4,679,352 | A | 7/1987 | Bates |
| 4,703,540 | A | 11/1987 | Davis |
| 4,726,092 | A | 2/1988 | Tacheny et al. |
| 4,860,811 | A | 8/1989 | Flakk |
| 4,937,976 | A | 7/1990 | Tucker et al. |
| 5,152,103 | A | 10/1992 | Tucker et al. |
| 5,289,656 | A | 3/1994 | Vetter |
| 5,444,942 | A | 8/1995 | Knudsen |
| 5,815,984 | A | 10/1998 | Sheets et al. |
| 5,924,244 | A | 7/1999 | Ohman |
| 5,983,569 | A | 11/1999 | Karlsson |
| 6,314,681 | B1 | 11/2001 | Moody |
| 7,690,154 | B2 | 4/2010 | Muir |
| 8,046,954 | B2 | 11/2011 | Curtis et al. |
| 2006/0218864 | A1 | 10/2006 | Blomqvist |
| 2008/0256874 | A1 | 10/2008 | Curtis et al. |

FOREIGN PATENT DOCUMENTS

| | | | |
|---|---|---|---|
| EP | 436946 | A1 | 7/1991 |
| EP | 542050 | A1 | 5/1993 |
| GB | 1128564 | | 9/1968 |
| GB | 1128564 | A | 9/1968 |
| GB | 2273314 | A | 6/1994 |
| WO | WO-2008124032 | A1 | 10/2008 |

OTHER PUBLICATIONS

"U.S. Appl. No. 12/062,471, Non Final Office Action mailed Jan. 19, 2011", 8 pgs.

"U.S. Appl. No. 12/062,471, Notice of Allowance mailed Jun. 27, 2011", 5 pgs.

"U.S. Appl. No. 12/062,471, Response filed Apr. 19, 2011 to Non Final Office Action mailedJan. 19, 2011", 11 pgs.

"U.S. Appl. No. 12/062,471, Restriction Requirement mailed 1Oct. 4, 2010", 6 pgs.

"International Application Serial No. PCT/US2008/004338, Search Report mailed Jul. 21, 2008", 7 pgs.

"International Application Serial No. PCT/US2008/004338, Written Opinion mailed Jul. 21, 2008", 9 pgs.

"European Application Serial No. 08742521.1, Office Action mailed Jan. 18, 2012", 6 pgs.

"U.S. Appl. No. 12/062,471, Preliminary Amendment filed Jul. 29, 2008", 3 pgs.

"U.S. Appl. No. 12/062,471, Response filed Nov. 4, 2010 to Restriction Requirement mailed Oct. 4, 2010", 8 pgs.

OUTSWINGING WINDOW ASSEMBLY HAVING AN OPERATIONAL MODE AND A WASH MODE AND METHOD OF OPERATION

CLAIM OF PRIORITY AND RELATED APPLICATIONS

This application is a continuation of and claims the benefit of priority under 35 U.S.C. §120 to U.S. patent application Ser. No. 12/062,471, filed Apr. 3, 2008, now U.S. Pat. No. 8,046,954, entitled "OUTSWINGING WINDOW ASSEMBLY HAVING AN OPERATIONAL MODE AND A WASH MODE AND METHOD OF OPERATION," which claims the benefit of priority under 35 U.S.C. §119(e) to U.S. Provisional Application Ser. No. 60/909,913 filed Apr. 3, 2007, and of U.S. Provisional Application Ser. No. 60/909,924 filed Apr. 3, 2007, which applications are incorporated by reference and made a part hereof in their entirety.

TECHNICAL FIELD

An outswinging window assembly having an operational mode and a wash mode.

BACKGROUND

During operation of a casement window, the casement window is movable between a closed position and an egress position. In the egress position, the window sash extends generally perpendicular to the window frame and is disposed adjacent to one side of the window jamb. As the window rotates to the egress position, it is common for the hinge stile of the sash to slide horizontally into the window opening. The more the sash slides over into the opening, the less opening is available through which to egress from the building, for example, in the case of an emergency.

In the closed position, the inside of the casement window can be easily cleaned from the interior of the building. However, the outside of the window is not readily accessible in the egress position since the sash is too close to the window jamb to allow a person to easily reach out and wash the outside of the window. Alternatively, the hinge stile of the sash can move over to allow for a person to reach through the opening; however, this interferes with the egress opening.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
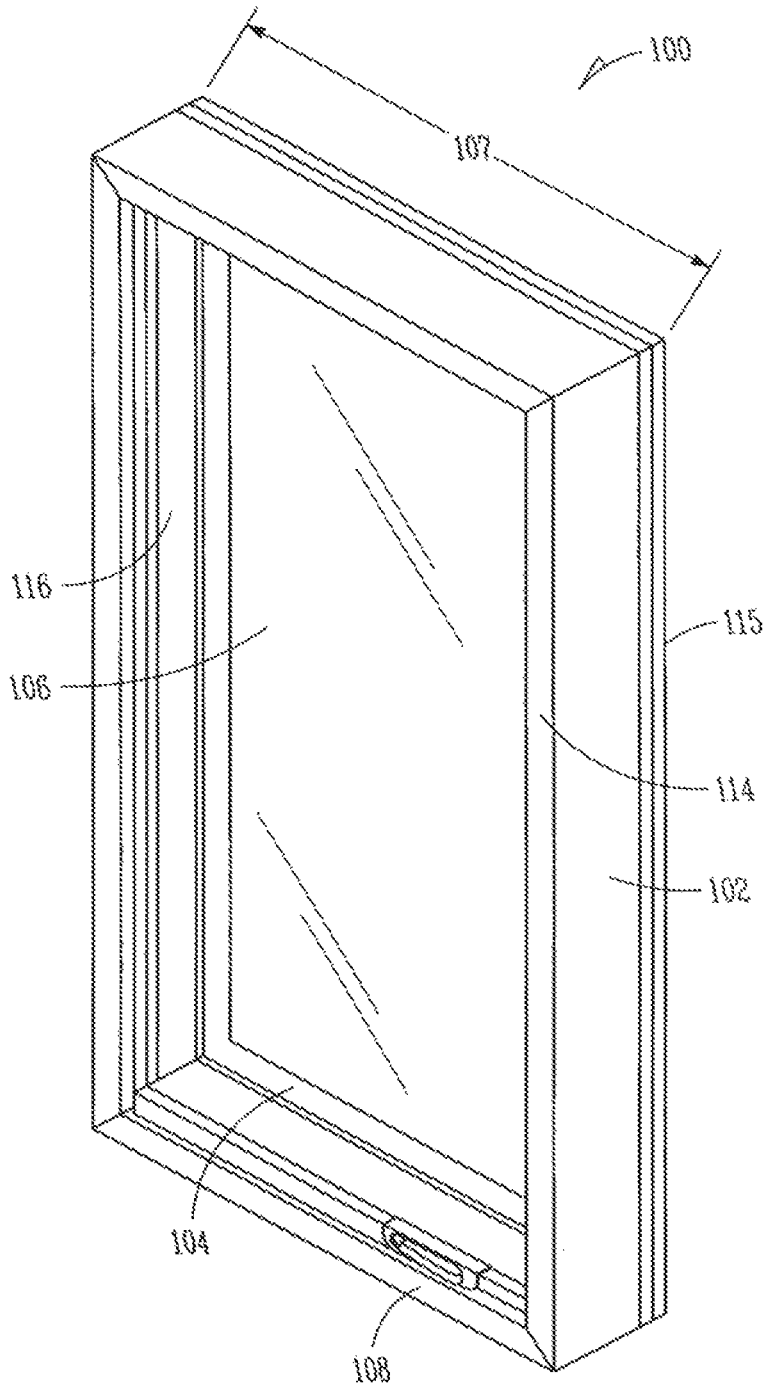
FIG. 1 is a perspective view of a window assembly with the sash in a closed position, as constructed in accordance with one embodiment.
Figure 3:
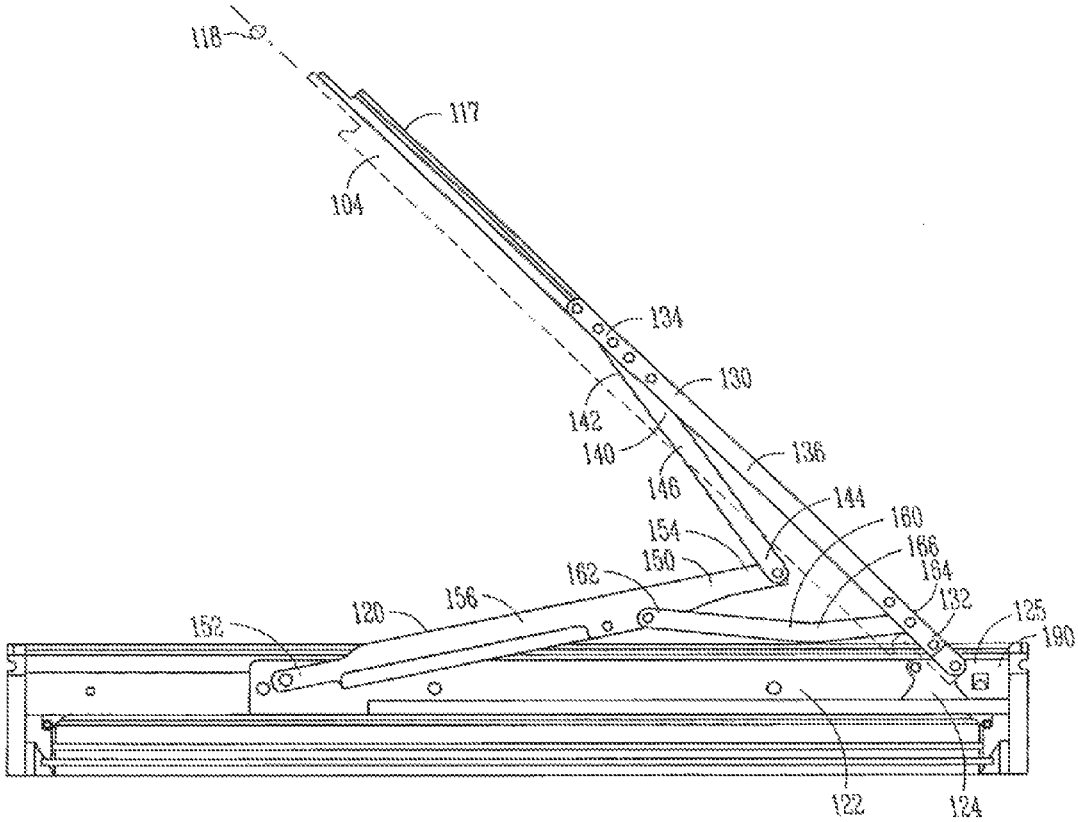
FIG. 3 is a top view of a portion of a drive mechanism for the window assembly, as constructed in accordance with one embodiment.

A window assembly 100, such as, but not limited to, a casement window, is shown in FIG. 1. The window assembly 100 includes a frame 102 and a sash 104 rotatably coupled relative to a frame 102. For example, the sash 104 rotates about a vertical axis. In one example, at least one pane of glass 106 is retained within the sash 104. The frame 102 is defined by an interior portion 114 and an exterior portion 115, and the sash 104 is defined by a sash interior portion 116 and a sash exterior portion 117 (FIG. 3). In an option, insulating material 180 (FIG. 9) is provided along an outer portion of the sash 104, such as at a lower rail of the sash 104. For example, weather strip material 182 (FIG. 9) is provided along a lower portion of the sash 104.

Figure 4:
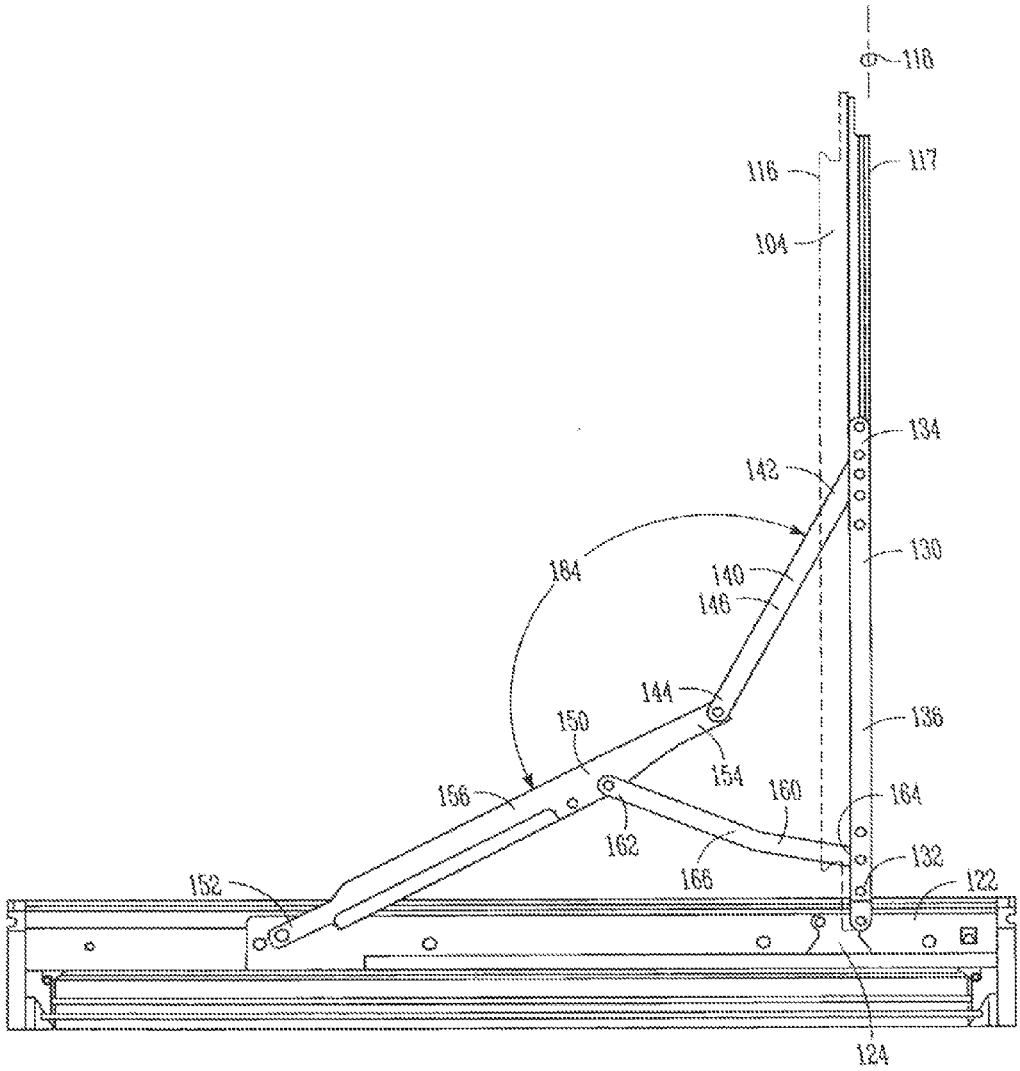
FIG. 4 is a top view of a portion of a drive mechanism for the window assembly, as constructed in accordance with one embodiment.
Figure 7:
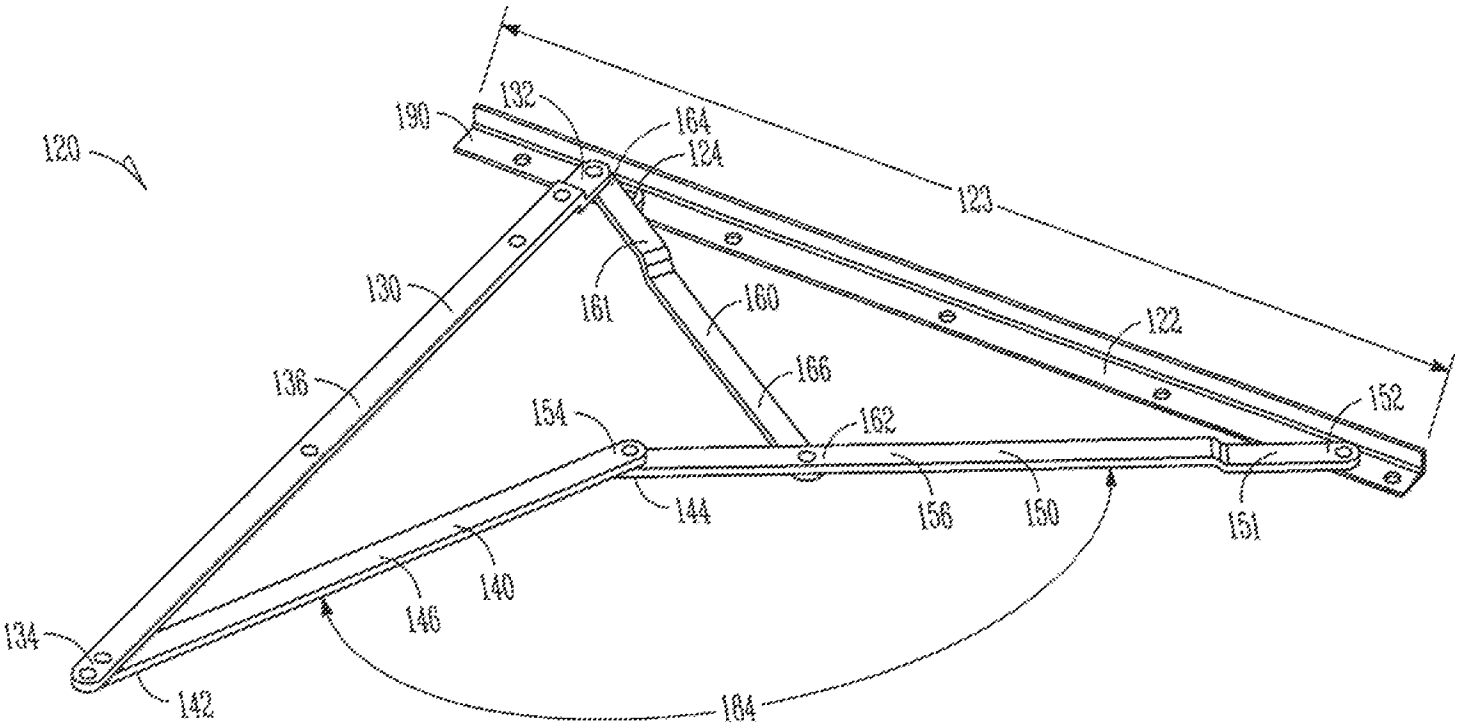
FIG. 7 is a perspective view of a portion of a drive mechanism for the window assembly, as constructed in accordance with one embodiment.

The window assembly 100 includes an operating mode in which the window assembly 100 can be moved from the closed position, where the sash interior portion 116 faces in a similar direction as the frame interior portion 114, to an open position at which the sash 104 is about perpendicular with the frame 102 (FIG. 4). As shown in FIG. 7, the window assembly 100 further includes a wash mode in which the sash 104 can be moved from a position perpendicular to the frame, to a position where the sash exterior portion 117 (FIG. 3) faces toward the frame interior portion, allowing for a person within the interior of a building to reach and clean an exterior portion of the sash 104, such as the exterior glass.

Figure 10:
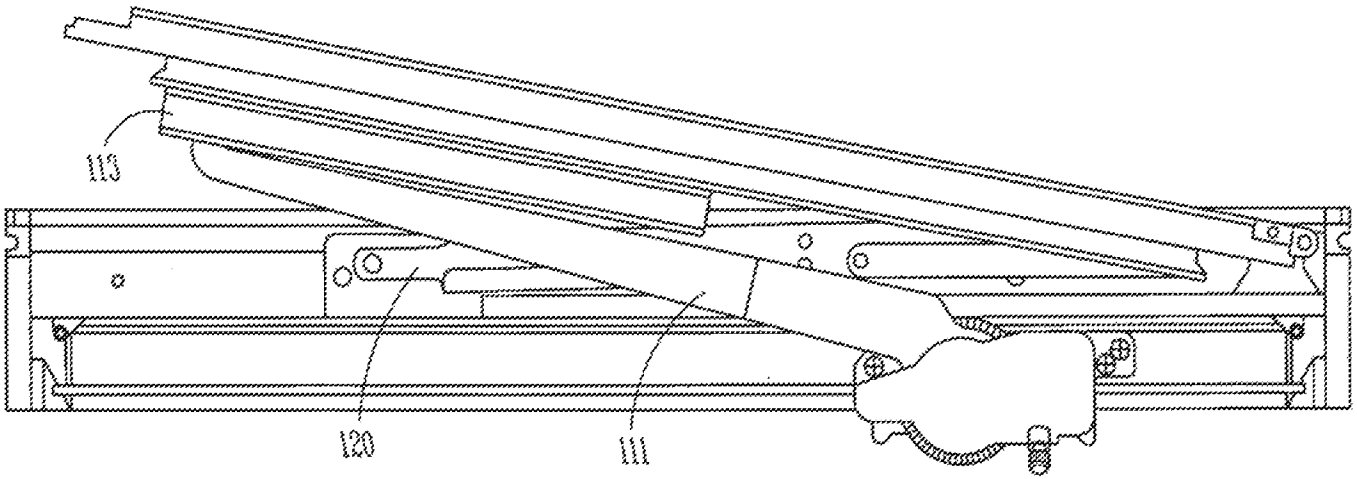
FIG. 10 is a top view of a portion of a drive mechanism for the window assembly, as constructed in accordance with one embodiment.
Figure 11:
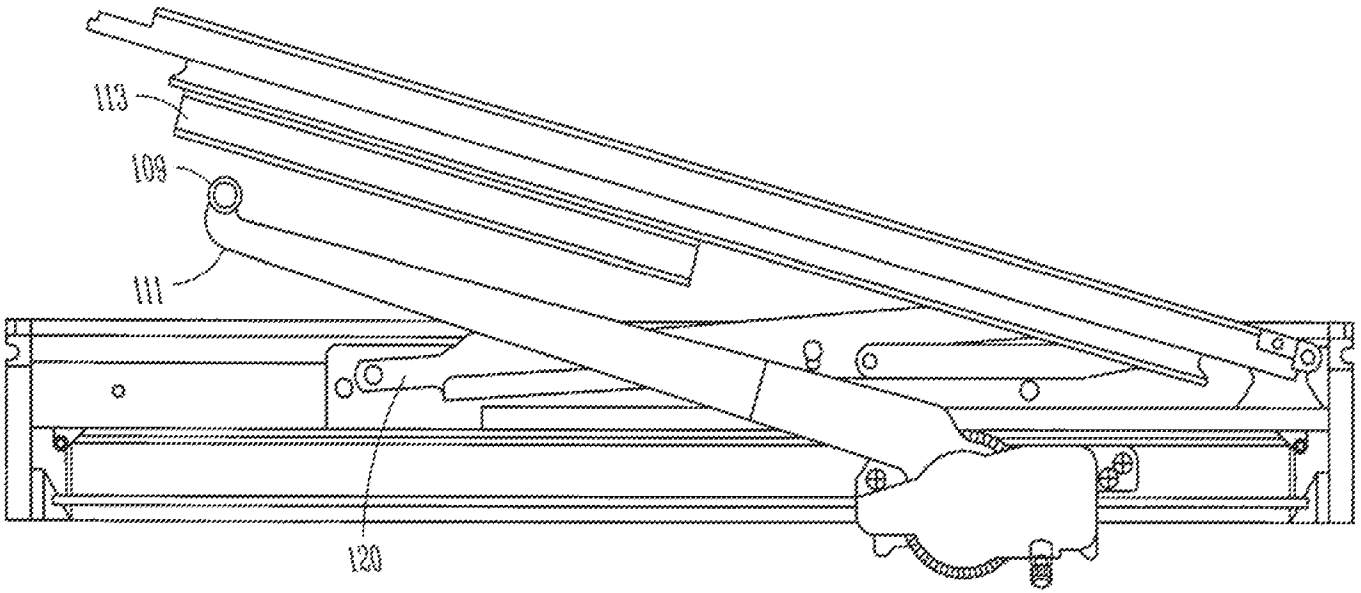
FIG. 11 is a top view of a portion of a drive mechanism for the window assembly, as constructed in accordance with one embodiment.
Figure 12:
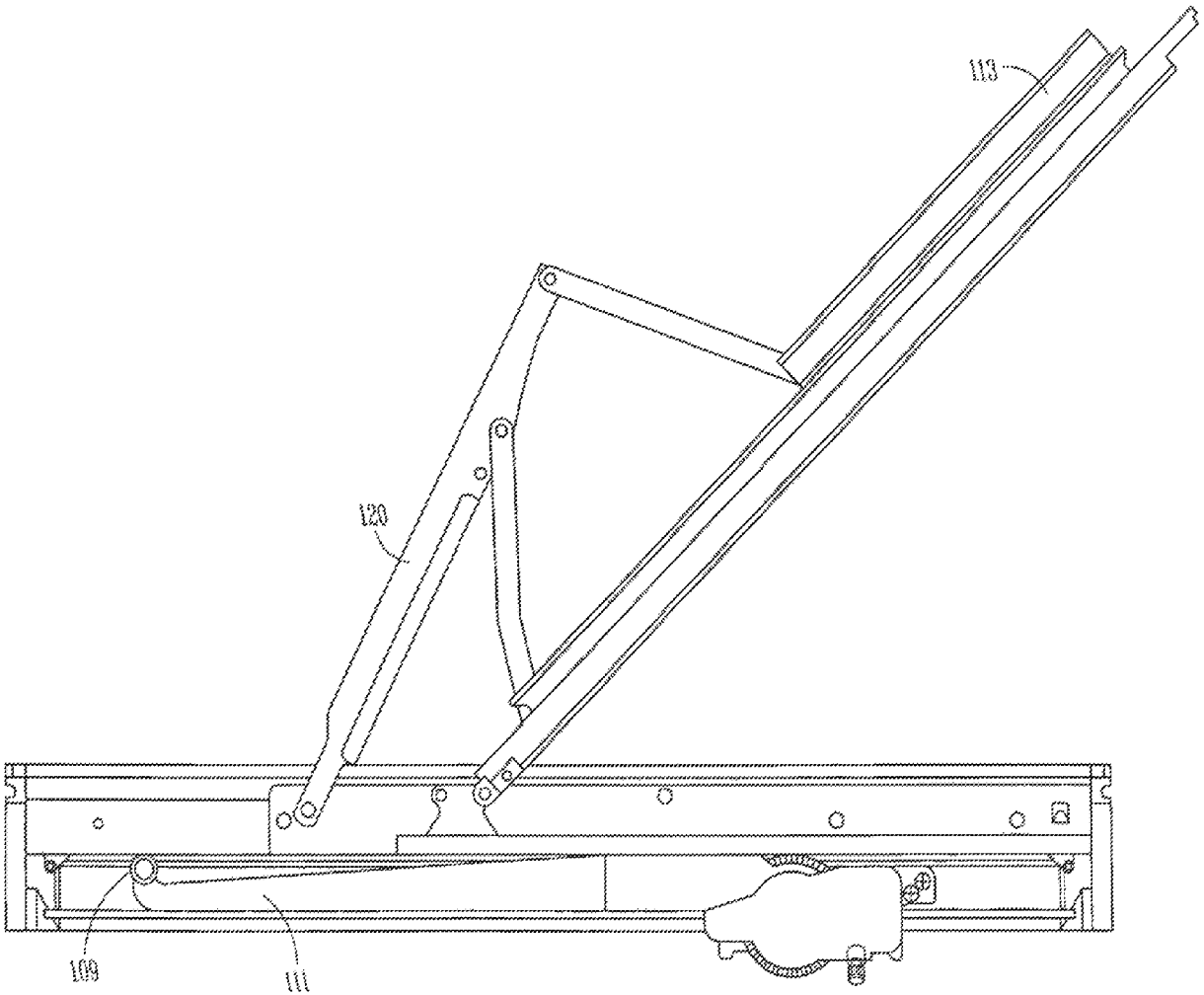
FIG. 12 is a top view of a portion of a drive mechanism for the window assembly, as constructed in accordance with one embodiment.
Figure 13:
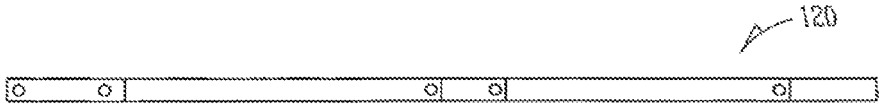
FIG. 13 is a top view of a portion of a drive mechanism for the window assembly, as constructed in accordance with one embodiment.
Figure 14:
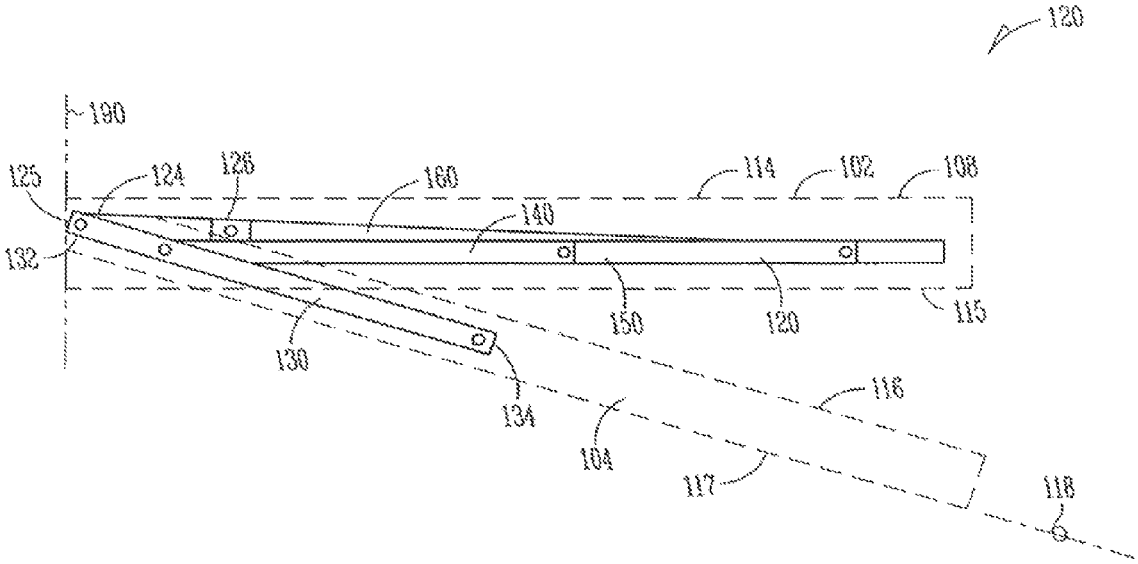
FIG. 14 is a top view of a portion of a drive mechanism for the window assembly, as constructed in accordance with one embodiment.
Figure 15:
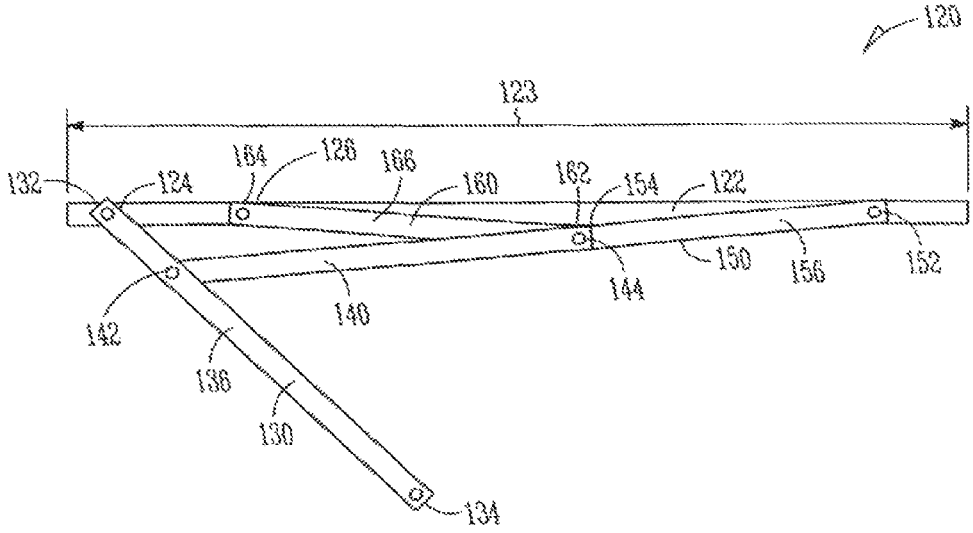
FIG. 15 is a top view of a portion of a drive mechanism for the window assembly, as constructed in accordance with one embodiment.
Figure 16:
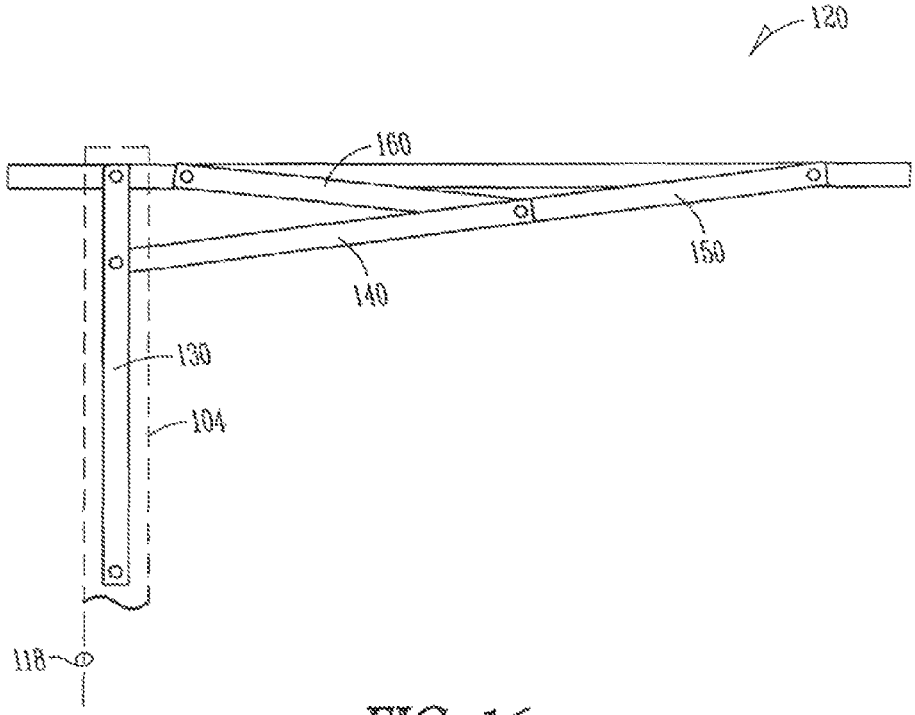
FIG. 16 is a top view of a portion of a drive mechanism for the window assembly, as constructed in accordance with one embodiment.
Figure 17:
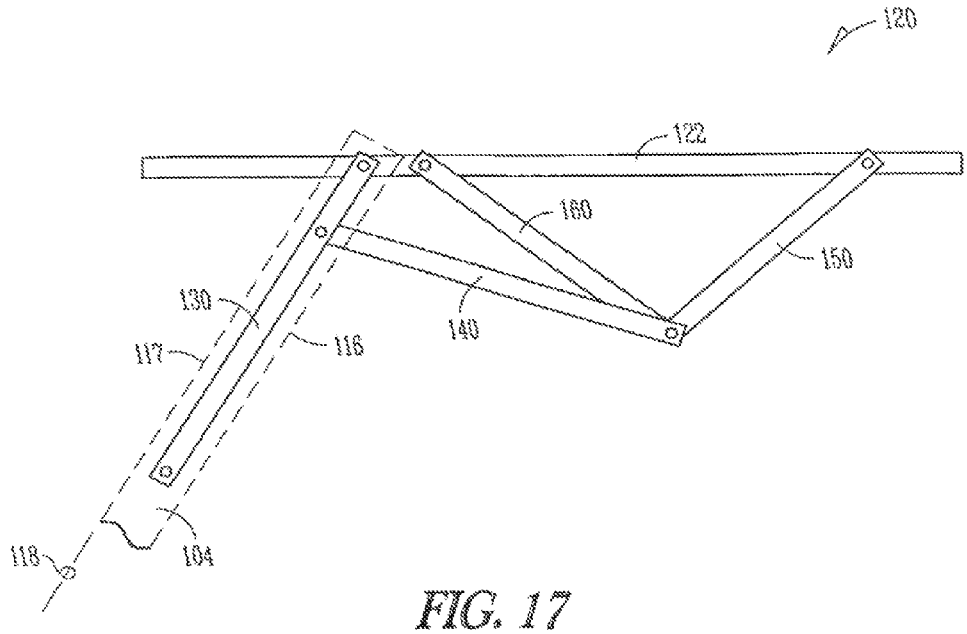
FIG. 17 is a top view of a portion of a drive mechanism for the window assembly, as constructed in accordance with one embodiment.
Figure 18:
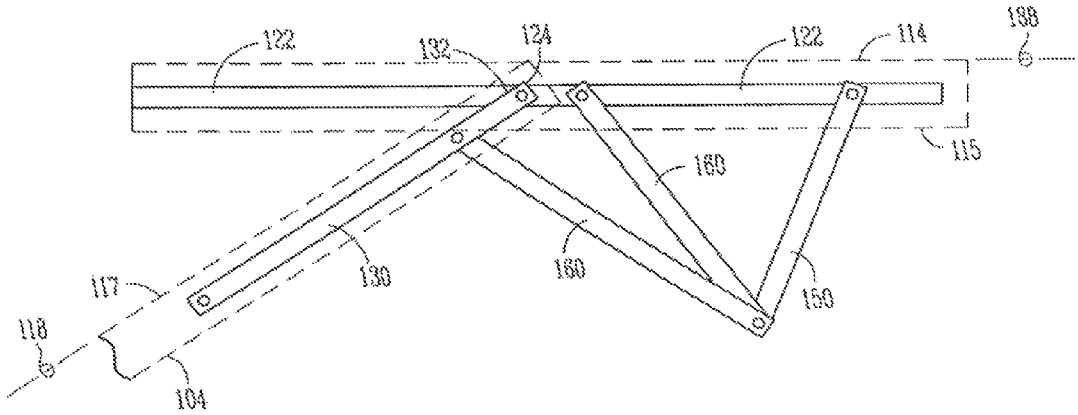
FIG. 18 is a top view of a portion of a drive mechanism for the window assembly, as constructed in accordance with one embodiment.

Referring to FIG. 3, the window drive mechanism includes a hinge assembly 120 that is coupled between the frame 102 and the sash 104. In an option, the hinge assembly 120 is coupled with the sash via an actuator arm 111, as shown in FIGS. 10-12. The actuator arm 111 moves along a sash track 113, where a pin 109 of the actuator arm 111 glides along the track 113. In an option, the user switches the window from the operational mode to the wash mode by uncoupling the actuator arm 111 from the sash track 113. For example, the actuator arm 111 is moved away from the sash track 113, for example by depressing the actuator arm 111, and the pin 109 is disengaged from the sash track 113. Once disengaged, the sash 104 can move independently of the actuator arm 111 using the hinge assembly 120, as can be seen in FIGS. 11 and 12. In a further option, the sash can change from a wash mode to the operational mode without requiring the window drive mechanism to be switched.

Figure 5:
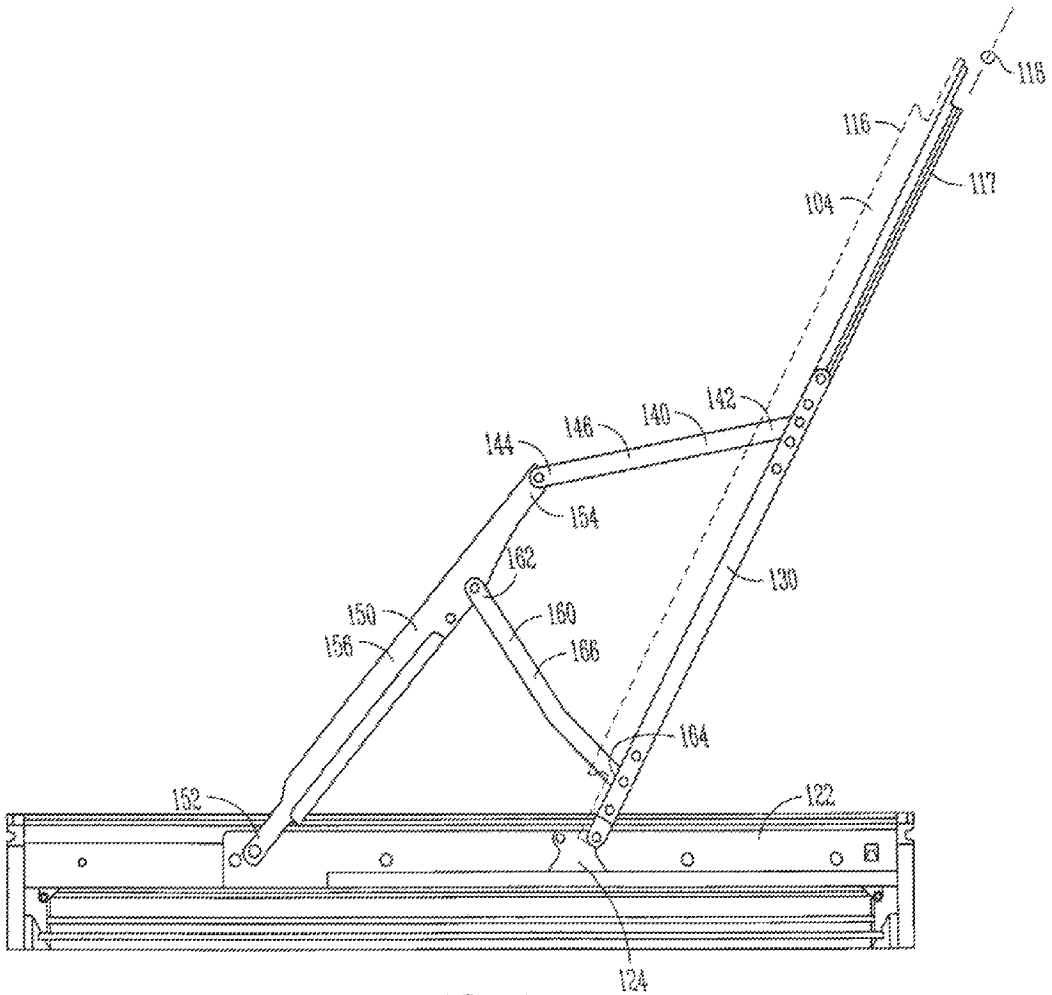
FIG. 5 is a top view of a portion of a drive mechanism for the window assembly, as constructed in accordance with one embodiment.
Figure 6:
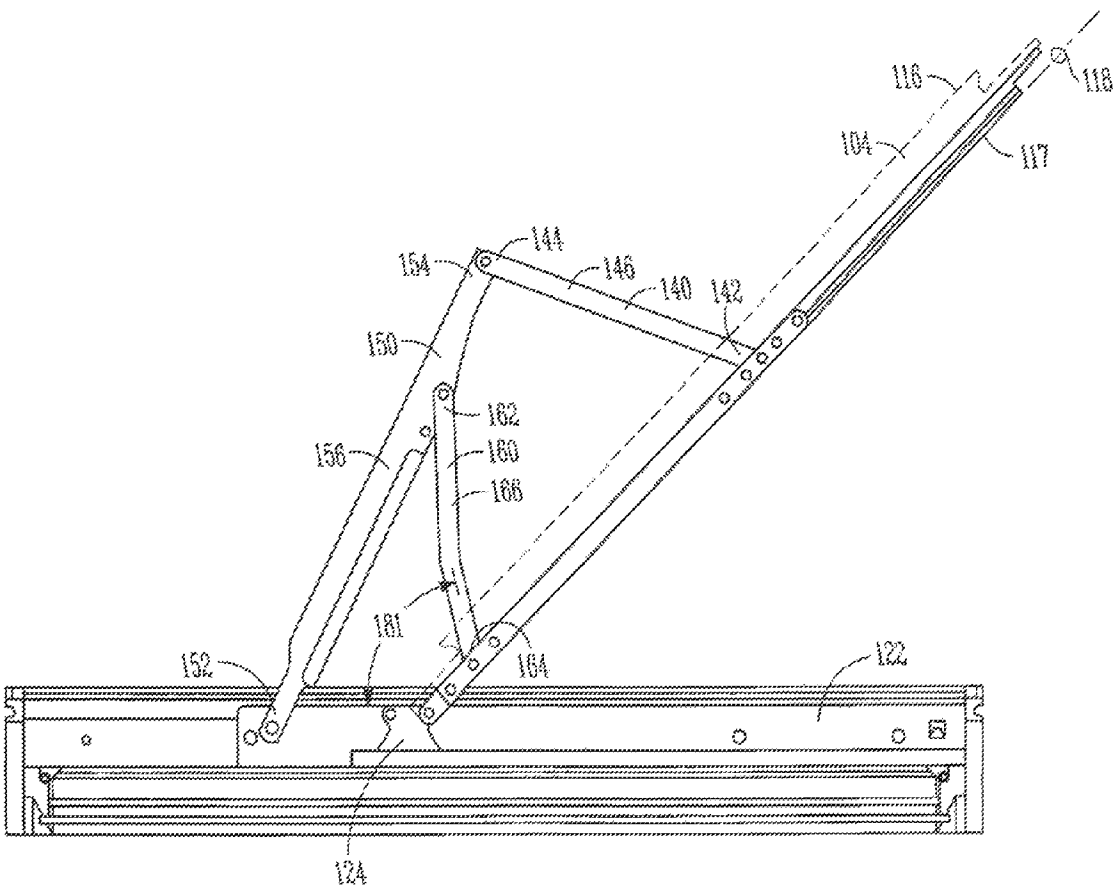
FIG. 6 is a top view of a portion of a drive mechanism for the window assembly, as constructed in accordance with one embodiment.
Figure 19:
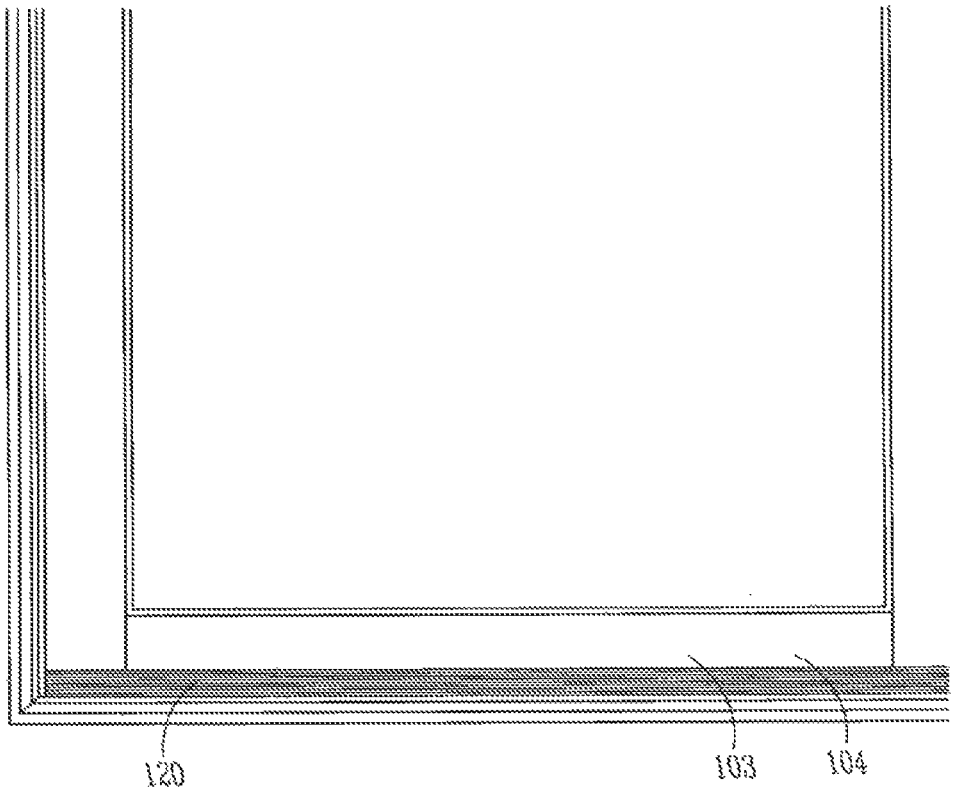
FIG. 19 is an exterior view of the sash as constructed in accordance with one embodiment.

In an option, the hinge assembly 120 is located near a lower rail 103 (FIG. 19) of the sash 104. In another option, the hinge assembly 120 is located near an upper rail of the sash 104. In yet another option, the hinge assembly 120 is located both on upper and lower rails of the sash 104, or on opposite sides of the sash 104. The hinge assembly 120 is coupled with the frame 102 and operated to move the sash 104 between a closed position (FIGS. 1 and 2) and an open position (FIGS. 3-4), and further to a wash position (FIGS. 5-6). Optionally, the window drive mechanism includes a crank that allows for an operator to drive the window drive mechanism. A worm gear assembly, in an option, is coupled with the crank and bottom rail and the links, such as a first link 130 (FIGS. 2-6) or an actuator arm 111 (FIGS. 10-12). In an option, the worm gear assembly includes a worm gear movably coupled with a drive gear and the drive gear is in turn coupled with a driven gear. Optionally, the window drive mechanism includes a base cover adapted to couple with a base plate. The base cover and the base plate cooperate to retain the worm gear, drive gear and the driven gear in position within the window drive mechanism.

In a further option, the window assembly 100 includes a locking mechanism that retains the sash 104 along the frame 102 and prevents opening of the window assembly 100. It should be noted the window assembly 100 can be a casement window, which operates with a rotatable sash that rotates around a vertical axis. In another option, the window assembly 100 includes an awning window, where a sash rotates about a horizontal axis. In yet another option, the window assembly 100 can include a push-out window, where a worm gear assembly may not be necessary.

Referring to FIGS. 2-7, one example of the window drive mechanism 120 is shown. The window drive mechanism includes a number of links, including, but not limited to, a first link 130, a second link 140, a third link 150, and a fourth link 160. The window drive mechanism 120 further includes a track 122 that is disposed along one of the frame members 108 (FIG. 1) of the frame 102 (FIG. 1), where the track 122 is defined in part by a track length 123 (FIG. 7). A first shoe 124 is slidably coupled with the track 122. In an option, the first shoe 124 is a single shoe, and is the only shoe used for the window assembly 100. Optionally, additional shoes can be used for the assembly, as further discussed below.

The first link 130 extends from a first link end 132 to a second link end 134, and has an intermediate link portion 136 therebetween. The first link 130 is coupled along an edge portion 112 of the sash 104, and the first link 130 remains substantially parallel with the plane defined by the sash 104 during movement of the sash 104. The first link 130 is rotatably coupled with the first shoe 124 at or near the first end 132 of the first link 130 and moves with the first shoe 124 along the track 122.

The second link 140 extends from a first link end 142 to a second link end 144, and has an intermediate link portion 146 therebetween. The third link 150 extends from a first link end 152 to a second link end 154, and has an intermediate link portion 156 therebetween.

The second link 140 is hingedly coupled with the first link 130 and the third link 150. The first link end 142 of the second link 140 is hingedly coupled with the second end 134 of the first link 130, and the second link end 144 of the second link 140 is hingedly coupled with the second link end 154 of the third link 150. The third link 150 is hingedly coupled with the second link 140 and the track 122, where the first link end 152 of the third link 150 is hingedly coupled with the track 122, in an option, at a fixed point. In an option, the third link 150 does not travel along the track 122 while the sash 104 (FIG. 7) rotates, but rotates relative to the track 122. Optionally, the third link 150 includes a recessed portion 151 (FIG. 7), in an option near the first link end 152. The recessed portion 151 (FIG. 7) allows for the link to be non-planar along a portion of the link, and allows for the hinge assembly 120 to be folded upon itself in the closed position, allowing for end 134 and end 142 to be disposed over the recessed portion 151 of link. It should be noted the recessed portion is optional, allowing for further options for the hinge stacking height.

Figure 8:
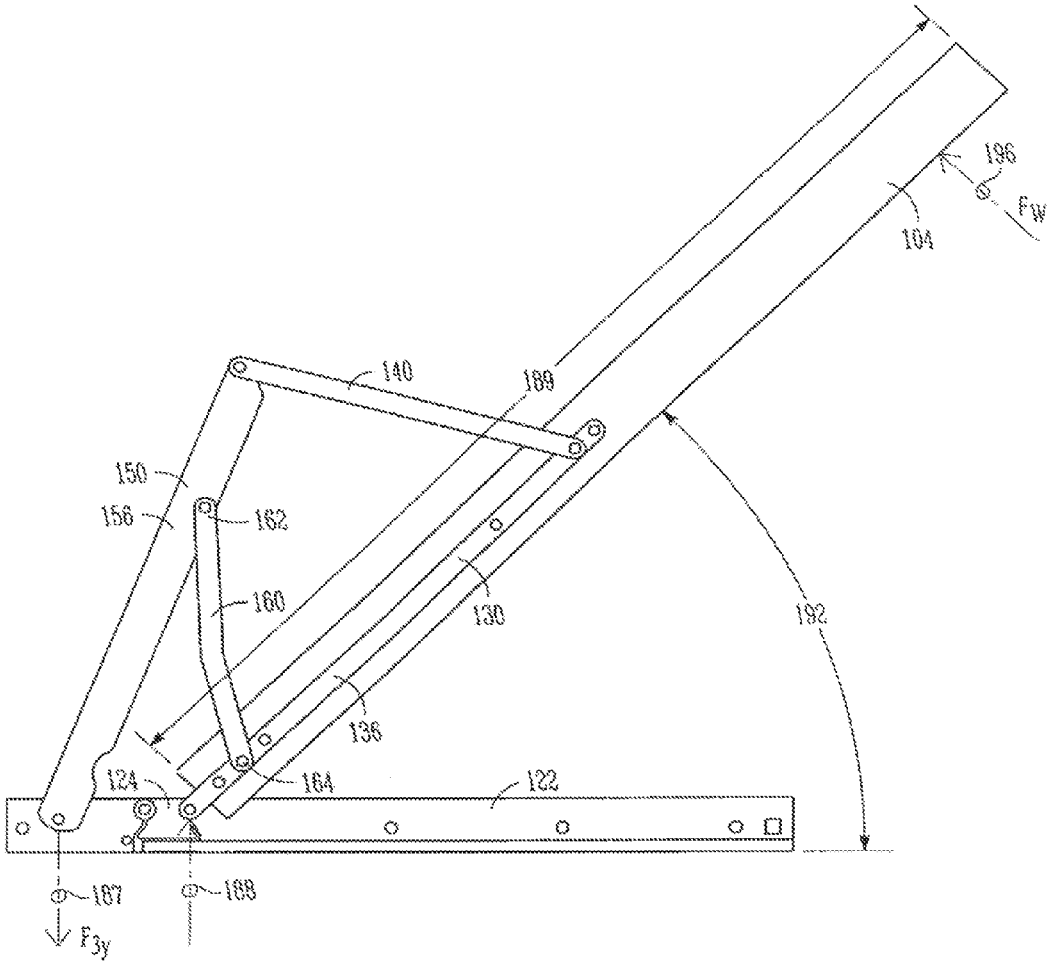
FIG. 8 is a top view of a portion of a drive mechanism for the window assembly, as constructed in accordance with one embodiment.

The fourth link 160 extends from a first link end 162 to a second link end 164, and has an intermediate portion 166 therebetween. In an option, the fourth link 160 includes a raised portion 161 (FIG. 7). The raised portion 161 (FIG. 7) allows for the link 160 to be rotated to a closed position over the first shoe 124. In a further option, as shown in FIG. 8, link 160 is slightly curved to allow for the second link 140 to set along side it in the closed position.

Referring again to FIG. 3, the fourth link 160 is coupled between the shoe 124 and the third link 150, in one option. The second end 164 of the fourth link 160 is hingedly coupled with the first shoe 124, and the second end 164 slides along the track 122 via the first shoe 124. The first end 162 of the fourth link is hingedly coupled with the third link 150 at the intermediate portion 156 of the third link 150. The fourth link 160 can be coupled with the shoe 124 and/or the first link 130 at a number of different locations. For example, the second end 164 of the fourth link 160 can be coupled with the shoe 124 at a location other than the hinge point of the first link 130 and the shoe 124. In another option, the second end 164 of the fourth link 160 could be coupled along the first link 130 other than the hinge point of the first link 130 and the shoe 124. For example, the second end 164 of the fourth link 160 could be coupled with an intermediate portion 136 of the first link 130 (FIG. 8), or near the ends of the first link 130. Notably the links can be adjusted so that the links are coupled near the ends of the links.

Figure 2:
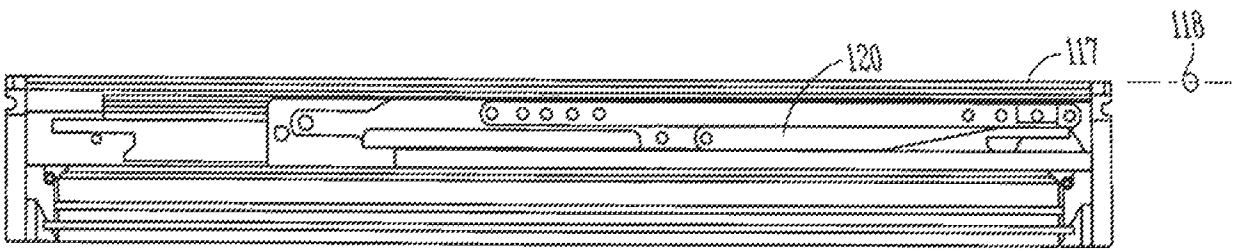
FIG. 2 is a top view of a portion of a drive mechanism for the window assembly, as constructed in accordance with one embodiment.

FIGS. 1 and 2 illustrate a sash 104 and/or the window drive mechanism 120 disposed in a closed position. As a user operates the crank to open the sash, the first link 130 and the sash 104 rotates relative to 190 (FIG. 3), or a first end 125 (FIG. 3) of the track 122. As the first link 130 rotates, a first end 132 of the first link 130 begins to slide along the track 122 via the first shoe 124, as shown in FIGS. 3 and 4. In this position, the window assembly is in the operating mode. In an option, the sash 104 is placed in an open position, where the sash is substantially transverse to the frame. The sash 104 moves via the shoe 124, and in an option, the shoe 124 moves a distance of about 4-21% of the frame width 107 (FIG. 1) when moved to the open position. In another option, the sash 104 moves via the shoe 12, and the shoe 124 moves a distance of no greater than 12% of the frame width 107 (FIG. 1) when moved to the open position. In an option, the frame width can be 20 inches to about 56 inches. Additional examples of shoe 124 movement when the sash is placed in the open position include: shoe 124 moves a distance of 2.68 inches for a frame having a width of 13 inches, 27.125 inches, or 40 inches.

In yet another option, the first shoe 124 moves a distance of more than 30% of the frame width, for example, when the sash 104 is moved to the wash position. For example, the shoe 124 can travel about 17⅜ inches when placed in the wash position for windows having a frame width 107 of about 24 inches to 56 inches. In another example, the shoe will travel about 13⅜ inches when placed in the wash position for windows having a frame width 107 of about 20-44 inches. In an option, the sash exterior is at 135 degrees relative to the frame when the sash 104 is in the wash position. In an option, as the sash 104 moves toward the open position and/or the wash position, the hinge assembly 120 and the links 130, 140, 150, 160 of the of the hinge assembly 120 do not pass through the plane 118 defined by the exterior portion 117 of the sash 104 (FIGS. 2-6). In another option, as the sash 104 moves toward the open position, the hinge assembly 120 remains between a sash plane 118 defined by the sash exterior portion and a frame 188 plane defined by the frame interior portion 114. In a further option, the hinge assembly does not pass over insulating material 180 (FIG. 9), such as a weather strip 182 (FIG. 9), surrounding at least a portion of the sash 104, when the sash moves to the wash position.

In yet another option, the sash 104 rotates at a first rate relative to shoe travel as the sash 140 moves from the closed position to a position where the sash 104 is substantially transverse to the frame, and the sash 104 rotates at a second rate relative to shoe travel as the sash 140 moves from the transverse position to the wash position. For example, the sash 104 rotates at about 33 degrees per inch in the first rate, and at about 3 degrees per inch in the second rate.

As the first link 130 rotates, and as the first shoe 124 slides along the track 122, fourth link 160 also rotates. In an option, when the sash 104 has been opened to about the position shown in FIG. 11, the actuator arm 111 is uncoupled from the sash 104, and the user uses the sash 104 to further open the sash 104. In another option, as the first link 130 rotates, the second link 140 and the third link 150 rotate and become almost parallel with one another, as shown in FIG. 4, and the sash 104 is in an open position, where the egress and clear opening is maximized. For example, the sash 104 is generally perpendicular to the frame 102, as shown in FIG. 4. Link 140 and link 150 open to an angle 184 relative to one another. In an option, the link 140 and link 150 open to an angle 184 of less than about 180 degrees prior to entering the wash mode.

The sash 104 continues to rotate relative to 190, and the shoe 124 continues to slide along the track 122, and the sash 104 is disposed at an angle greater than 90 degrees relative to the frame, and the window assembly is entering the wash mode. When entering the wash mode, link 140 and link 150 continue to rotate relative to one another such that angle 184 becomes greater than 180 degrees, resulting in an over center configuration in the hinge assembly 120 in the wash position. As a user applies force on the glass, the resulting force on the shoe 124 is directed more in a normal direction to the track 122 than in a tangential direction, and the frictional force between the track and the shoe 124 is greater than the tangentially directed force applied by the user. For instance, in an example shown in FIG. 8, a user places a wash force $F_w$ 196 on the sash 104, for example near an outer portion of the glass when the sash 104 having a width 189 is at a wash angle 192, resulting in normal forces $F_{3y}$, 187 and $F_{2y}$, 188, wherein the $F_{3y}$, 187 and $F_{2y}$, 188 are a normal pin force for link 150 and a normal force for the shoe 124, respectively. In an example, the wash force $F_w$ 196 is about 17 lbs, the wash angle 192 is about 45 degrees, the sash width 189 is about 30 inches, the pin force $F_{2y}$ is about 102 lbs, and the normal force for the shoe 124 $F_{3y}$ is about 109 lbs. While this examples does not account for sash weight, the example illustrates how the hinge assembly 120 provides for increased stability of the window when in the wash mode or in the wash position as the force placed on the glass by the user results in a great normal force placed on the shoe 124, thereby resisting lateral movement in the wash position. If a user placed a greater amount of $F_w$, a $F_w$ of 34 lbs, using the same variables as above, the resultant normal force for the shoe 124 $F_{3y}$ would be about 220 lbs. The normal force for the shoe 124 $F_{3y}$ increases the frictional force between the shoe 124 and the track 122, thereby resisting lateral motion of the sash 104 along the track 122 when the sash 104 is in the wash position.

In an option, in order to move the sash from the wash mode to the normal open or closed position, the sash must actually translate in a direction opposite of a force applied when washing a window (i.e. normal to the glass). Notwithstanding that the sash is stable for a user to wash the exterior glass, the sash 104 can be easily moved from the wash mode or position to a closed position by sliding the stile 194 near the hinge (FIG. 5).

In the wash mode, the sash 104 can be further rotated relative to the frame 102, as shown in FIGS. 6 and 7. The first link 130 and the sash 102 continue to rotate relative to the frame 102, and the first shoe 124 continues to slide along the track 122. In the wash mode, as the first shoe 124 slides along the track 122, the second link 140 and the third link 150 rotate relative to one another. The first end 132 of the first link 130 continues to rotate, and travels along the track 122 such that the first end 132 of the first link 130 has traveled more than 30% along the length of the length of the window width. The sash 104 is rotated, via the first link 130, such that an exterior portion of the sash is directed toward the exterior portion of the frame, as shown in FIG. 7. In this position, a user can easily clean the sash 104, such as the exterior glass portion of the sash.

In the wash position, the fourth link 160, in an option, is disposed substantially transverse to the track 122, and assists in stabilizing the sash 104 in the wash position. Other angles for the fourth link 160 relative to the track 122 can be used. For example, the angle 181 (FIG. 6) between link 160 and track 122 can be about 70-90 degrees. In another option, the angle 181 can be 60-90 degrees. In yet another option, the angle 181 can be 50-90 degrees. In still yet another option, the angle 181 can be 45-90 degrees. When a user places force on the glass of the sash 104, the force is driven into the first shoe 124 in a substantially normal direction, assisting in stabilizing the sash 104 from movement along the track 122.

The window assembly allows for the egress to be maximized when the window sash is in the open position, and further allows for a person to easily clean an exterior portion of the sash and glass when the sash is in the wash position. The window assembly allows for a person to manipulate the window from the interior to place the sash in the closed position, to an open position, and further to a wash position.

Further options for the hinge assembly are as follows, and additional embodiments can be seen in FIGS. 13-19. For instance, the second link 140 is hingedly coupled with the first link 130 and the third link 150. The first link end 142 of the second link 140 is hingedly coupled with an intermediate link portion 136, and the second link end 144 is hingedly coupled with the second link end 154. The third link 150 is hingedly coupled with the second link 140 and the track 122, where the first third link end 152 is hingedly coupled with the track 122, in an option, at a fixed point. In an option, the third link does not travel along the track 122, but rotates relative to the track 122.

The forth link 160 extends from a first link end 162 to a second link end 164, and has an intermediate fourth link portion 166 therebetween. The fourth link 160 is coupled between the track 122 and end portions of the second link 140 and the third link 150. The second link end 164 of the fourth link 160 is hingedly coupled with the second shoe 126, and the second link end 164 slides along the track 122 via the second shoe 126. The first link end 162 of the fourth link 160 is hingedly coupled with the second link 140 and the third link 150 at their respective second ends.

As the first link 130 rotates, and as the first shoe 124 slides along the track 122, the second shoe 126 remains fixed and does not move, in an option. In another option, as the first link 130 rotates, and as the first shoe 124 slides along the track 122, the second shoe 126 moves along the track 122 at a slower rate than the first shoe 124. In another option, as the first link 130 rotates, the second link 140 and the third link 150 remain fixed together and do not rotate relative to one another. In another, the second link 140 and the third link 150 remain fixed until the sash 104 reaches a position where the sash 104 is perpendicular to the frame 102, as shown in FIG. 5. At this point, when the sash 104 interior portion is at an angle greater than 90 degrees relative to the frame, the window assembly is entering the wash mode. The hinge assembly 120 and the links 130, 140, 150, 160 do not pass through the plane 118 (FIG. 9) as the sash 104 moves to and through this position.

Figure 9:
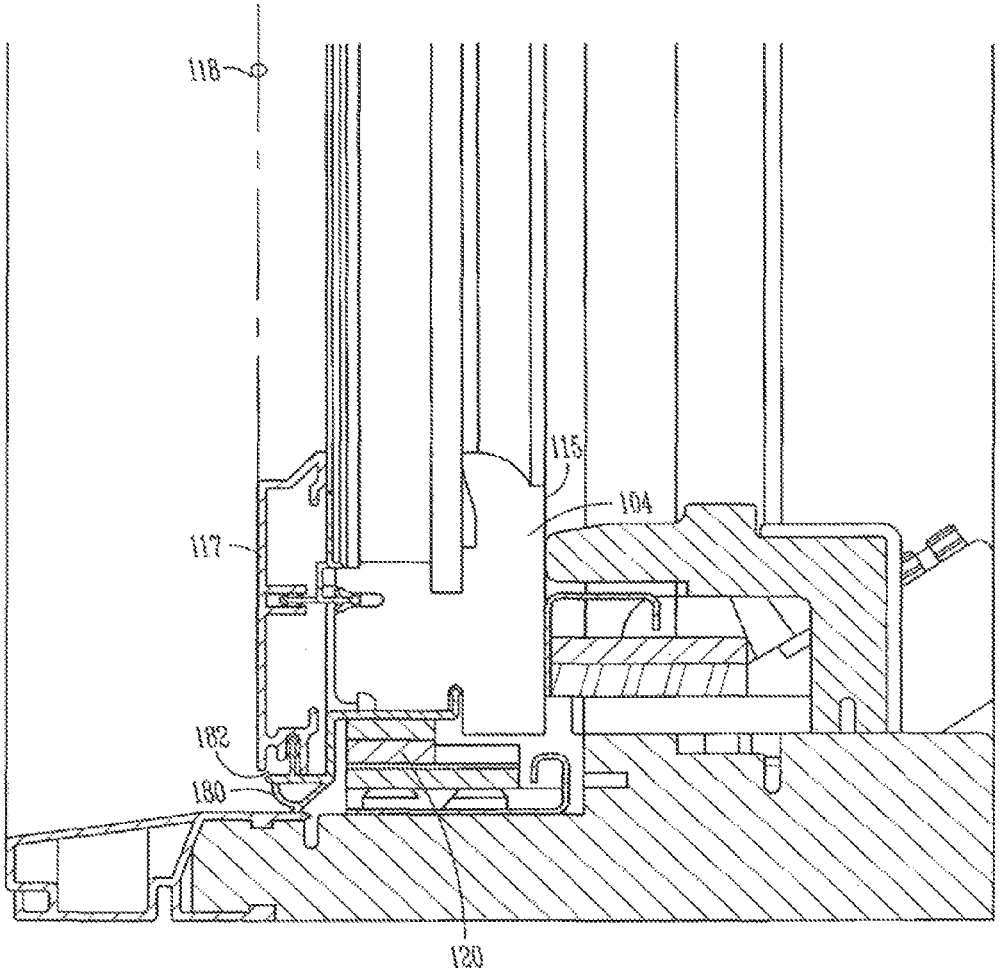
FIG. 9 illustrates a cross-sectional view of a window assembly, as constructed in accordance with one embodiment.

In the wash mode, the sash 104 can be further rotated relative to the frame 102, as shown in FIGS. 6 and 7. The first link 130 and the sash 102 continue to rotate relative to the frame 102, and the first shoe 124 continues to slide along the track 122. In the wash mode, as the first shoe 124 slides along the track 122, the second shoe 126 also slides along the track 122, where the two shoes 124, 126 slide together. In an option, the first shoe 124 and the second shoe 126 slide along the track at the same rate. In the wash mode, the second link 140 and the third link 150 rotate relative to one another, and the relative distance between the first shoe 124 and the second shoe 126 along the track 122 remains substantially constant. The first end of the first link continues to rotate, and travels along the track 122 such that the first end of the first link 130 has traveled more than 30% along the length of the frame width, or in another option more than 50% along the length of the frame width. The sash 104 is rotated, via the first link 130, such that an exterior portion of the sash is directed toward the exterior portion of the frame. In this position, a user can easily clean the sash 104, such as the exterior glass portion of the sash. As the sash 104 is moved to this position, the hinge assembly 120 and the links 130, 140, 150, 160 do not pass through the plane 118 (FIG. 9).

The window assembly allows for the egress to be maximized when the window sash is in the open position. For example, the hinge assembly 120 minimizes encroachment of the clear opening when the sash is in the open position. Lateral movement of the hinge assembly 120 from a closed position to a normal open position (90 degrees), in an option, is a maximum of 13.5% of the egress width. In another option, the lateral movement is limited to a maximum of 12%.

The window assembly further allows for a person to easily clean an exterior portion of the sash and glass when the sash is in the wash position. The window assembly allows for a person to manipulate the window from the interior to place the sash in the closed position, to an open position, and further to a wash position. Furthermore, the hinge assembly allows for the sash to be opened without altering the vertical alignment of the sash relative to the frame.

During operation and wash mode, the hinge mechanism links 130, 140, 150, 160 do not pass the plane 118 of the sash 104, allowing for insulating material of the sash to conceal the hinge assembly 120 when the sash is in the closed position (FIGS. 8 and 9), and the hinge assembly 120 is disposed behind the cladding covering the lower rail 103 of the sash 104. In addition, the gap around the sash 104, between the sash and the frame, can be minimized because the lower portion 182 of the sash 104, and/or the sash plane 118 defined by the sash exterior portion 117 do not pass over the links 130, 140, 150, 160. Still further, when the sash is placed in the closed position, the hinge assembly is concealed both from the exterior and the interior.

In an example method, a method includes rotating two or more links of a window assembly hinge assembly from a window assembly closed position to a window assembly open position, where the window assembly has a frame including a frame interior portion and a frame exterior portion. The frame is defined in part by a frame width. The window assembly further includes a sash rotatably coupled relative to the frame, and the sash has a sash inner portion and a sash exterior portion, where the sash exterior portion is disposed toward the second direction when the sash is in a closed position. The sash exterior portion defines a sash exterior plane, and the sash has a wash mode and an operational mode.

In the operational mode, the sash is openable to an open position, in the wash mode the sash is openable to a wash position, and in the wash position the sash exterior portion is disposed toward the frame interior portion. The window assembly further includes an optional window drive mechanism coupled between the frame and the sash, and the window drive mechanism includes a hinge assembly having one or more links coupled with one or more shoes, the shoes movably coupled along a first side of the frame. The method further includes rotating two or more links includes rotating the sash, for instance around a vertical axis, and maintaining the rotatable links between a sash plane defined by the sash exterior portion and a frame plane defined by the frame when moved to the open position, and further preventing the rotatable links from crossing the sash plane when moving the sash toward the wash position, or optionally the hinge assembly does not pass over insulating material disposed along a lower rail of the sash when the sash moves to the wash position.

Further options for the method are as follows. For instance, the method further optionally includes moving a first shoe towards a second shoe for the window assembly, and moving the first shoe independent of the second shoe in the operational mode, and/or moving the first shoe and the second shoe together in the wash mode. In another option, rotating two or more links includes rotating second and third links from a relative angle of less than 180 degrees in the open position to greater than 180 degrees in the wash position.

Further options for the method include stabilizing the sash against movement when the sash is in the wash mode. In yet another option, moving the one or more shoes a distance of about 4-21% of the frame width along a track when the sash is moved from the closed position to a position where the sash is substantially transverse to the frame. In yet another option, the method includes moving the one or more shoes a distance of no greater than 12% of the frame width when the sash is moved from the closed position to a position where the sash is substantially transverse to the frame.

It is to be understood that the above description is intended to be illustrative, and not restrictive. Many other embodiments will be apparent to those of skill in the art upon reading and understanding the above description. It should be noted that embodiments discussed in different portions of the description or referred to in different drawings can be combined to form additional embodiments of the present application. The scope of the invention should, therefore, be determined with reference to the appended claims, along with the full scope of equivalents to which such claims are entitled.

What is claimed is:

1. A window assembly comprising:

a frame including a frame interior portion and a frame exterior portion, the frame defined in part by a frame width, the frame including a first jamb;

a sash having a sash inner portion and a sash exterior portion, the sash exterior portion defining a sash exterior plane, the sash having four sides forming a rectangle, the frame and sash being configured such that when the sash is closed, an entire first side of the sash abuts the first jamb;

the sash having a wash mode and an operational mode, in the operational mode the sash is openable to an open position, in the wash mode the sash is movable to a wash position, in the wash position the sash exterior portion is directed toward the frame exterior portion; and a hinge assembly coupled between the frame and the sash, the hinge assembly having three or more links;

wherein the hinge assembly is configured such that when the sash is in the open position and substantially orthogonal to the frame, the entire first side of the sash that abutted the first jamb when the sash was closed is proximate the first jamb, and when the sash is in the wash position, the entire first side of the sash that abutted the first jamb when the sash was closed is remote from the first jamb.

2. The window assembly of claim 1, wherein the first side of the sash travels a distance of no greater than 12% of the frame width when the sash moves from the closed position to the open position where the sash is substantially orthogonal to the frame.

3. The window assembly of claim 1, wherein the first side of the sash travels a distance of at least 30% of the frame width when the sash is in the wash position.

4. The window assembly of claim 1, wherein the first side of the sash travels a distance of at least 50% of the frame width when the sash is in the wash position.

5. The window assembly of claim 1, wherein the hinge assembly does not cross the sash exterior plane when the sash moves to the wash position from the closed position.

6. The window assembly of claim 1, wherein the sash exterior is at least 135 degrees relative to the frame when the sash is in the wash position.

7. The window assembly of claim 1, wherein the hinge is configured such that the sash egress opening is maximized when the sash is in the open position.

8. The window assembly of claim 1, further comprising a track located on the frame to slidably receive a shoe coupled to the hinge assembly.

9. The window assembly of claim 8, wherein the shoe is coupled with the first side of the sash, and the first side of the sash and the shoe move together from proximate the jamb in the open position to the location remote from the jamb in the wash position.

10. The window assembly of claim 1, wherein the hinge assembly is configured such that the window moves continuously from the open position substantially orthogonal to the frame to the wash position.

11. A window assembly comprising:

a frame including a frame interior portion and a frame exterior portion, the frame defined in part by a frame width, the frame including a first jamb;

a sash having a sash inner portion and a sash exterior portion, the sash exterior portion defining a sash exterior plane, the sash having four sides forming a rectangle, the frame and sash being configured such that when the sash is closed, an entire first side of the sash abuts the first jamb;

the sash having a wash mode and an operational mode, in the operational mode the sash is openable to an open position where the sash is orthogonal to the frame, in the wash mode the sash is moveable to a wash position, in the wash position the sash exterior portion is directed toward the frame exterior portion; and a hinge assembly coupled between the frame and the sash, the hinge assembly having three or more links;

wherein the hinge assembly is contained between the sash exterior plane and the frame interior portion throughout movement of the sash from a closed position to the open position and to the wash position, and the entire first side of the sash that abutted the first jamb when the sash was closed travels from a position proximate the first jamb to a position remote from the first jamb when the sash moves to the wash position from the open position.

12. The window assembly of claim 11, wherein the first side of the sash travels a distance of no greater than 12% of the frame width when the sash moves from the closed position to the open position.

13. The window assembly of claim 11, wherein the first side of the sash travels a distance of at least 30% of the frame width when the sash is in the wash position.

14. The window assembly of claim 11, wherein the first side of the sash travels a distance of at least 50% of the frame width when the sash is in the wash position.

15. The window assembly of claim 11, wherein the hinge is configured such that a sash egress opening is maximized when the sash is in the open position.

16. The window assembly of claim 11, further comprising a track located on the frame to slidably receive a shoe coupled to the hinge assembly.

17. The window assembly of claim 11, wherein the hinge assembly is configured such that the window moves directly from an open position substantially orthogonal to the frame to the wash position.

18. A window assembly comprising:

a frame including a frame interior portion and a frame exterior portion, the frame defined in part by a frame width, the frame including a first jamb;

a sash having a sash inner portion and a sash exterior portion, the sash exterior portion defining a sash exterior plane, the sash having four sides forming a rectangle, the frame and sash being configured such that when the sash is closed, an entire first side of the sash abuts the first jamb;

the sash having a wash mode and an operational mode, in the operational mode the sash is openable to an open position, in the wash mode the sash is movable to a wash position, in the wash position the sash exterior portion is directed toward the frame exterior portion; and a hinge assembly coupled between the frame and the sash, the hinge assembly having three or more links;

wherein the hinge assembly is configured such that when the sash is in the open position and substantially orthogonal to the frame, the entire first side of the sash that abutted the first jamb when the sash was closed is proximate the first jamb, and wherein the entire first side of the sash that abutted the first jamb when the sash was closed is continuously movable from proximate the first jamb in the open position to a location remote from the first jamb in the wash position.

19. The window assembly of claim 18, wherein the hinge is configured such that the sash egress opening is maximized when the sash is in the open position.

20. The window assembly of claim 18, wherein the hinge assembly does not cross the sash exterior plane when the sash moves to the wash position from the closed position.

21. The window assembly of claim 18, further comprising a shoe slidably received within a track extending along at least a portion of the frame width, wherein the shoe slidably couples the first side of the sash with the frame, wherein the shoe and the first side of the sash are continuously slidable from proximate the jamb to the location remote from the jamb.

22. The window assembly of claim 18, wherein the first side of the sash travels a distance of no greater than 12% of the frame width when the sash moves from the closed position to the open position where the sash is substantially orthogonal to the frame.

23. The window assembly of claim 18, wherein the first side of the sash travels a distance of at least 30% of the frame width when the sash is in the wash position.

24. The window assembly of claim 18, wherein the first side of the sash travels a distance of at least 50% of the frame width when the sash is in the wash position.

25. A window assembly comprising:

a frame including a frame interior portion and a frame exterior portion, the frame defined in part by a frame width, the frame including a first jamb;

a sash having a sash inner portion and a sash exterior portion, the sash exterior portion defining a sash exterior plane, the sash having four sides forming a rectangle, the frame and sash being configured such that when the sash is closed, an entire first side of the sash abuts the first jamb;

a hinge assembly coupled between the frame and the sash, the hinge assembly including a rotatable coupling moveable along the frame width, the rotatable coupling being coupled at the first side of the sash, the hinge assembly including three or more links;

the sash having a wash mode and an operational mode, in the operational mode the sash is openable to an open position, in the wash mode the sash is movable to a wash position, in the wash position the sash exterior portion is directed toward the frame exterior portion wherein the hinge assembly is configured such that when the sash is in the open position and substantially orthogonal to the frame, the entire first side of the sash that abutted the first jamb when the sash was closed and the rotatable coupling are proximate the first jamb, and when the sash is in the wash position, the entire first side of the sash that abutted the first jamb when the sash was closed and the rotatable coupling are remote from the first jamb.

26. The window assembly of claim 25, wherein the first side of the sash and the rotatable coupling travel a distance of no greater than 12% of the frame width when the sash moves from the closed position to the open position where the sash is substantially orthogonal to the frame.

27. The window assembly of claim 25, wherein the first side of the sash and the rotatable coupling travel a distance of at least 30% of the frame width when the sash is in the wash position.

28. The window assembly of claim 25, wherein the first side of the sash and the rotatable coupling travel a distance of at least 50% of the frame width when the sash is in the wash position.

29. The window assembly of claim 25, wherein the hinge assembly does not cross the sash exterior plane when the sash moves to the wash position from the closed position.

30. The window assembly of claim 25, further comprising a track located on the frame to receive the rotatable coupling.

31. The window assembly of claim 30, wherein the rotatable coupling is slidably received within the track extending along at least a portion of the frame width, and the rotatable coupling and the first side of the sash are continuously slidable from proximate the jamb to the location remote from the jamb.

32. The window assembly of claim 25, wherein the hinge assembly is configured such that the window moves directly from the open position substantially orthogonal to the frame to the wash position.

* * * * *

UNITED STATES PATENT AND TRADEMARK OFFICE

CERTIFICATE OF CORRECTION

PATENT NO. : 8,707,621 B2
APPLICATION NO. : 13/253321
DATED : April 29, 2014
INVENTOR(S) : Curtis et al.

It is certified that error appears in the above-identified patent and that said Letters Patent is hereby corrected as shown below:

In the Claims

Column 12, line 8, in Claim 25, after “links;”, insert --and--, therefor

Column 12, line 13, in Claim 25, after “portion”, insert --;--, therefor

Signed and Sealed this
Eleventh Day of November, 2014

Michelle K. Lee

Michelle K. Lee
*Deputy Director of the United States Patent and Trademark Office*